United States Patent [19]

Persson et al.

[11] 4,259,654

[45] Mar. 31, 1981

[54] FLUX CONTROL IN TAPE WINDINGS

[75] Inventors: Erik Persson, Vesteras; Johnny Sundin, Ludvika, both of Sweden

[73] Assignee: ASEA Aktiebolag, Vesteras, Sweden

[21] Appl. No.: 34,508

[22] Filed: Apr. 30, 1979

[30] Foreign Application Priority Data

May 2, 1978 [SE] Sweden ..... 7804989

[51] Int. Cl.[3] ..... H01F 15/04

[52] U.S. Cl. ..... 336/84 R; 336/84 M; 336/212; 336/223

[58] Field of Search ..... 336/84 R, 84 C, 84 M, 336/223, 232, 177, 212

[56] References Cited

U.S. PATENT DOCUMENTS

| | | | |
|---|---|---|---|
| 3,183,467 | 5/1965 | Edwards | 336/223 |
| 4,012,706 | 3/1977 | Westendorp | 336/84 M |
| 4,021,764 | 5/1977 | Winn | 336/84 |
| 4,135,173 | 1/1979 | Philp | 336/223 X |

*Primary Examiner*—Thomas J. Kozma

*Attorney, Agent, or Firm*—Watson, Cole, Grindle & Watson

[57] ABSTRACT

Disclosed are improved constructions for power transformers and reactors having windings of tape-formed conductor material which tend to reduce additional losses in the windings. In the improved construction for a power transformer or reactor comprising a core containing magnetic material and having legs and a yoke and comprising windings including a tape-formed conductor material arranged concentrically around the core legs, the innermost of the windings has a first portion located nearest the core leg which has an axial length greater than the length of the portion of the winding located radially outside said first portion. The first portion thereby forms a cylindrical shield for controlling the magnetic leakage flux appearing outside the ends of the winding.

6 Claims, 8 Drawing Figures

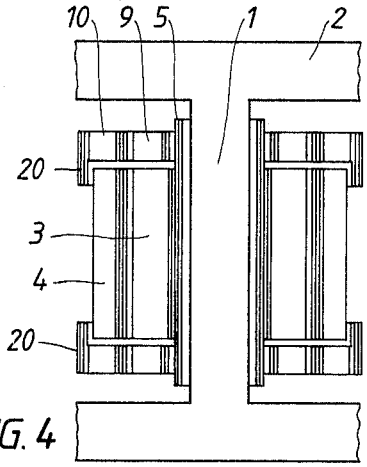
FIG. 4
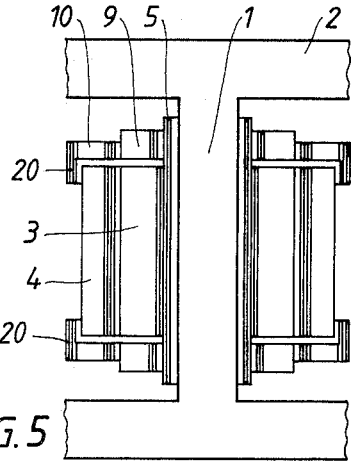
FIG. 5
FIG. 6
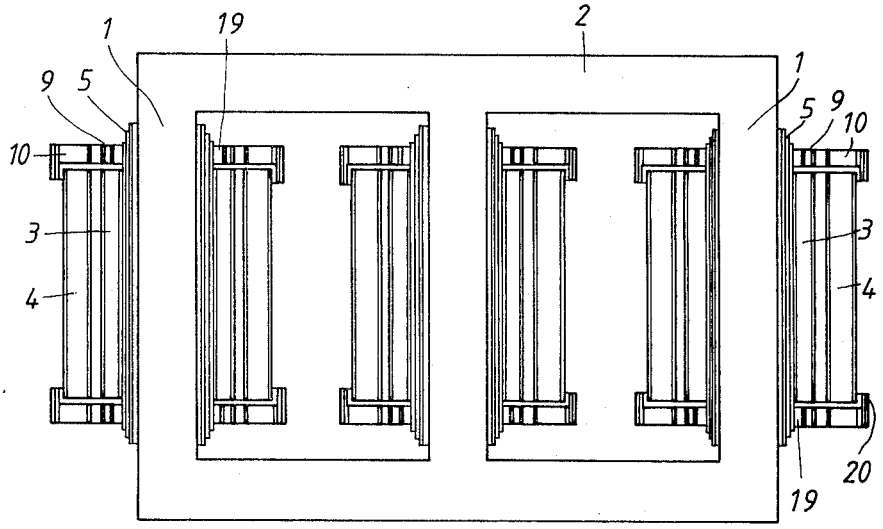

FLUX CONTROL IN TAPE WINDINGS

BACKGROUND OF THE INVENTION

The present invention relates to improved constructions for transformers and reactors having windings of tape-formed conductor material, the constructions reducing additional losses in the windings by controlling the magnetic flux at the ends of the windings.

The magnetic leakage flux primarily passing axially through the windings and in the gaps between the windings of a transformer or reactor tends to deflect at the ends of the windings and partially enter the core legs and therefore the flux also acquires a radial component. This component tends to become most pronounced at the corners of the cross-section of the winding which are nearest to the core leg that is surrounded by the winding. In conventional windings where the current is conducted in discrete conductors having a small extension in the radial and axial directions, a radial component of the magnetic flux also exists, but this component is not so heavily concentrated in a small region as is the case with tape windings.

In windings having conductors of tape-formed conductor material, especially in windings having a large radial extension, the strongly concentrated and radially directed leakage flux at the region about the ends of the windings will generate considerable additional losses caused by the eddy currents in the tapes which are induced by the radial component of the magnetic leakage flux. These losses limit the applications of tape-formed conductor material in transformer and reactor windings, although the use of such conductor material results in great advantages of various kinds. In conventional windings according to the above, admittedly eddy currents are induced and these currents cause losses through the radial component in the leakage flux, but these losses are limited to an acceptable level by choosing a conductor having a sufficiently small axial extension.

U.S. Pat. No. 4,060,784 to Fergestad illustrates how previously attempts have been made to eliminate the effect of the radial component of the leakage flux at the ends of transformer windings having tape-formed conductors. In this patent, leakage flux is controlled by means of plates 22 of a magnetically conductive material located between the conductor tapes. The magnetically conductive plates may extend throughout the whole winding from one end surface to the other, but as an alternative, the plates may be located only within one region nearest the ends of the windings as shown in FIGS. 4 and 5, the plates being are situated within the very winding.

However, by positioning the magnetically conductive material inside the winding parallel to the conductor tape 21, the diameter of the winding will increase and a deteriorated fill factor will result. The increased diameter of the winding will therefore require a longer iron core, a larger transformer tank and more oil. Thus, both an increased total volume and a higher total weight of the transformer will result which are considerable drawbacks which will increase with the size of the transformer.

In addition, since the flux-controlling plate 22 terminates at the end surface of the winding and the flux strives to deflect radially at the ends of the winding, the deflection of the flux, which in the absence of a controlling plate inside the winding starts at a distance from the winding end and successively increases towards the winding end, will be concentrated in a small region at the very end of the winding. This concentration will considerably increase the additional losses in a narrow zone at the very end surfaces of the winding and the temperature will increase in this zone to a considerably greater extent than what would have been the case had there been no flux-controlling plates inside the winding. Theoretical calculations performed also show that this is the case.

Furthermore, by introducing plates of such material inside the windings, the magnetic coupling is reduced between the windings and therefore the functions of the transformer are lessened.

British Patent Specification 990,418, published Apr. 28, 1965, illustrates another principle for controlling the radial component of the leakage flux for the purpose of reducing the additional losses in the winding ends when using taped-formed conductor material. This patent discloses that shields 20 of electrically conductive material are placed between the core legs and the inner winding as well as outside the outer winding. The shields extend axially outside the winding ends and the eddy currents in the shields, caused by the radial component of the leakage flux, generate a flux around the shields which tends to straighten the total leakage flux. However, in this device the inner shield occupies such a space inside the windings that all the windings have to be given an enlarged diameter which thereby results in a larger volume for the windings.

French Patent Specification 1,557,420 discloses a device in transformers for straightening the leakage flux passing between and through the windings so as to avoid additional losses at the ends of the windings. Outside the ends of the windings are arranged magnetic regions 8, 9 which are constructed from ferro-magnetic strips which are wound into a coil. The strip may be connected to the winding conductor in several different ways.

In transformers for great power where powerful leakage fluxes occur, the above-disclosed solution will with great probability not be sufficient. The flux density at the inner corners of the inner winding will become unallowably great despite the magnetic regions because the leakage flux will at least be partly deflected radially before reaching the ends of the winding. The proposed solution with only magnetic regions outside the winding ends is therefore not sufficient, especially for large units having great power with large leakage flux density.

SUMMARY OF THE INVENTION

The present invention relates to improved transformer or reactor constructions which remove or at least considerably reduce the disadvantages with the known constructions for controlling leakage flux. The fundamental concept of the invention is that the flux is prevented from starting to spread while the flux still runs inside the winding by making it impossible or at least very difficult for the radial component of the flux to form within the winding and also to achieve a certain amount of control of the leakage flux after it has left the winding. Control of the leakage flux is achieved, on the one hand, by forming the winding located nearest to a core leg with a first portion located nearest the core leg which has axial length greater than the length of the portion of the winding located outside said first portion so as to thereby provide a cylindrical shield which tends to suppress the radial component of the leakage flux directed inwardly towards the core leg, and on the other hand, by locating flux-controlling magnetic bodies outside the ends of the windings. By a special form of the magnetic body which is arranged at the ends of the innermost winding, a favourable cooperation is obtained between the body and the flux-controlling shield located on the innermost winding.

Further advantages and features of the present invention will become more fully apparent from a detailed consideration of the arrangement and construction of the constituent parts as set forth in the following specification taken together with the accompanying drawing.

DESCRIPTION OF THE DRAWINGS

In the drawing,

FIGS. 4 and 5 show details of the flux-controlling bodies, FIG. 6 shows a modified embodiment of the inner winding according to FIG. 1.

DETAILED DESCRIPTION OF THE PREFERRED EMBODIMENTS

Figure 1:
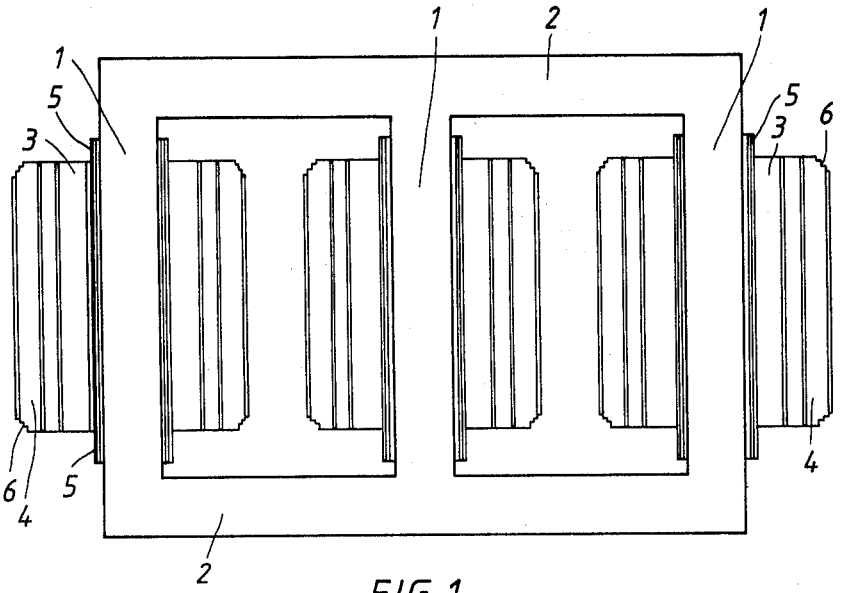
FIG. 1 shows a cross-section of a three-legged transformer having two windings per leg.

FIG. 1 illustrates a transformer core comprising core leg 1 and yokes 2. Each core legs 1 supports an inner winding 3, usually the low-voltage winding, and an outer winding 4. The windings are shown in all figures by vertical lines indicating a cross-section of the tape-formed winding conductor. In FIG. 1, the inner winding 3 is constructed such that its axial cross-section diminishes due to the portion of the winding located nearest to core leg 1 having a greater axial length than the remaining portion of the winding so as to thereby form cylindrical shield 5. Since the innermost portion of winding 3 has the lowest voltage, shield 5 can be relatively close to yoke 2 without causing a risk of an electric flashover. The magnetic leakage flux axially directed through inner winding 3 will now remain axial in the radially seen innermost portion of this winding up to the end of the protruding shield 5. Only at the end does the magnetic flux start showing a tendency of spreading, while forming the radial component, and to pass into core leg 1 and yoke 2 respectively. Due to the low voltage in shield 5, the end of the shield can lie close to yoke 2, and consequently the radial component of the flux is drastically reduced so that the loss increase in the shield becomes very moderate and easy to manage. The reduction of the radial component of the flux is due to the magnetic flux continuing axially directed into yoke 2. In addition to the reduction of the eddy current losses at the ends of the winding 3, a further advantage is realized in that the flux, when entering yoke 2, is directed parallel to the surface of the electrical sheets, thereby minimizing the eddy current losses therein. However, the flux going inwardly toward the core leg 1 will have the same direction as the perpendicular of the surface of the core sheets on two opposite sides of the leg, thereby resulting in large eddy currents and considerable additional losses in the sheet.

The embodiment of inner winding 3 according to the present invention will thus result in two considerable advantages, i.e., a reduction of the additional losses and the resultant temperature increase at the inner corners of the cross-section of winding 3 as well as a reduction of the additional losses in core leg 1. The latter additional losses also lead to increased temperatures which would limit the use of tape windings in large power transformers if the present invention is not applied. Both the described effects of shield 5 finally result in a reduction in the total losses of the transformer and therefore an increase in the total efficiency of the transformer.

A radial component of the magnetic flux will occur also in outer winding 4 with a concentration of eddy currents and losses at the outer corners of the cross-section of the winding. An improvement in these conditions can be achieved in this case as well by forming winding 4 with a variable distance between the end of winding and yoke 2, for example, by providing a sloping portion 6 which gives the winding an axial length which diminishes towards the outer edge of the winding.

To avoid joints in the conductor tape at the transition to a lower height of winding 3 after shield 5 has been manufactured, a tape is utilized having width equal to the total axial length of the shield. When shield 5 has been wound, a strip is cut off on either side of the tape so that the width of the tape is equal to the height of winding 3 outside the shield. The strips are cut off continuously as the winding is being produced. Alternatively, winding 3 can be wound from a tape having a width equal to the width of the outer portion of the winding. When winding the innermost portion of winding 3 with such a tape, shield 5 is obtained by winding two additional parallel tapes on either side of the principal tape and parallel to the principal tape. When outer winding 4 is to be produced, a tape width is started with which is substantially equal to the height of winding 3. To obtain sloping portion 6, strips are cut off at the two edges of the tape in a corresponding width.

Figure 2:
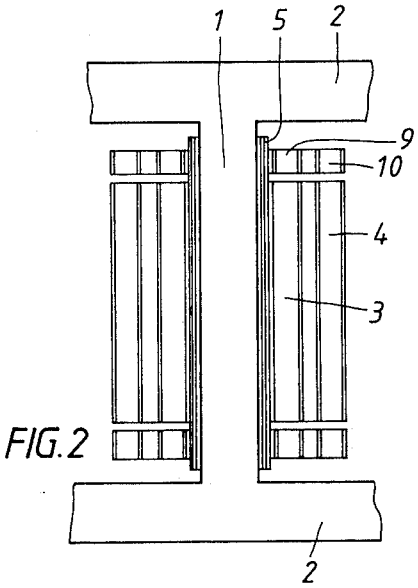
FIG. 2 shows the location of flux-controlling bodies at the ends of the windings.

FIG. 2 illustrates another construction for controlling the magnetic flux in a transformer or reactor. Outside the ends of the windings 3 and 4 respectively, flux-controlling bodies 9 and 10 respectively are placed which are manufactured from a material having high permeability, for example, transformer sheet. Bodies 9 and 10 are preferably formed as rings having substantially the same radial extension as the corresponding winding and are located as close as possible to the ends of windings 3 and 4 so as to attain the best flux-controlling effect. The tape edges of the winding and the body facing the winding should therefore, as closely as possible, have the same potential. The safest way to achieve the same potential is to manufacture the winding and the rings simultaneously and have the conductor tape in the winding of the same thickness as the sheet metal tape in the rings, and have the film used for insulation between the turns extend at least from the outer edge of one ring to the outer edge of the other ring. The manufacture thus takes place with the conductor tape in the center, a tape having high permeability on either side of the conductor tape and a common insulating film.

Figure 3:
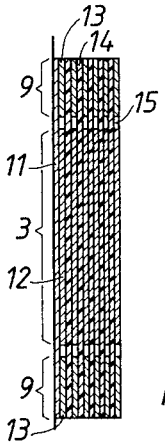
FIG. 3 shows a section through a winding on an enlarged scale.

This manufacture is more clearly shown in FIG. 3. At the inner edge of the respective winding 3 where the manufacture commences, conductive tape 11 is positioned which galvanically or capacitively connects winding 3 with the rings 9, one ring at either end of the winding. Tape 11 is connected both to the conductor tape 12 in the winding and to the tape 13 in the rings. The insulating film is designated 14. Because the manufacture of winding 3 and ring 9 takes place simultaneously and tapes 12 and 13 are connected to each other at the start of the winding and are also of equal thickness, the potential of the winding and the rings will be the same at all locations. Therefore, gap 15 between winding 3 and rings 9 can be made small. However, allowance must be made for the fact that the voltage increase may temporarily differ in winding 3 and rings 9, for example in the case of an impulse voltage, which may result in considerable potential drops across gap 15. To control the voltage cross rings 9 in relation to the voltage across winding 3, it may be necessary to connect the tape in the rings to the winding tape at several places by a galvanic or a capacitive coupling.

The ring-formed bodies 9 and 10 can also be constructed according to FIG. 4, where the bodies at the ends of the outer winding 4 have a portion 20 extending past the outer corner of the outer winding cross-section. The greater the portion of the distance between the end of winding and yoke 2 that is occupied by the magnetic material, the more efficient will be the effect of the material. Since winding 3 located nearest core 1 generally has the lowest voltage, and outermost winding 4 has the highest voltage, flux-controlling bodies 9 and 10 can also be located at different lengths from yoke 2, thus obtaining a cross-section as shown in FIG. 5 for example.

Ring-formed bodies 9 and 10 can also be manufactured from a number of insulating rings of tape-formed material having high permeability, the rings being insulated from each other. The voltage distribution across the body is then achieved capacitively. When there is a need to reduce the eddy current losses in the body, the body is made from thinner, parallel tapes. If the material has sufficiently high resistivity, the rings may be closed. Furthermore rings can be pressed from a magnetic powder material.

According to another embodiment, the metallic conductor in ring-formed bodies 9 and 10 may consist of two parallel tapes placed against each other. One of these tapes is of high permeability and such as an electric sheet and the other tape is of low permeability such as copper.

In the previously shown and described embodiments of the invention, those portions of shield 5 which are located outside the outer portion of the winding 3 are made with a constant radial thickness. However, in transformers for large electrical power which have a strong leakage flux, the radial leakage flux may give rise to an impermissibly high current density and additional losses at the outer corner of shield 5. To reduce these losses, shield 5 is made to slope at the outer corner so that the shield acquires a diminishing axial length with an increasing radial extension. In FIG. 6 which shows an example of such a shield, the sloping portion is achieved by winding the innermost part of shield 5 with a conductor having a width equal to the greatest axial length of the shield. After a specified number of turns, the width of the conductor is reduced so that shield 5 acquires a smaller axial length. By repeating the process, shield 5 having a stepwise decreasing axial length is attained.

Alternatively, shield 5 may be constructed from a conductor having a width which continuously diminishes so that a shield having continuously decreasing axial length results from an increased radial diameter of the shield. Shield 5 manufactured in accordance with the method described above has a greater ability to withstand strong leakage fields, especially at the outer corner facing away from core leg 1 and towards yoke 2, which is the corner most exposed to the radial component of the leakage flux and has the greatest additional losses.

Figure 7:
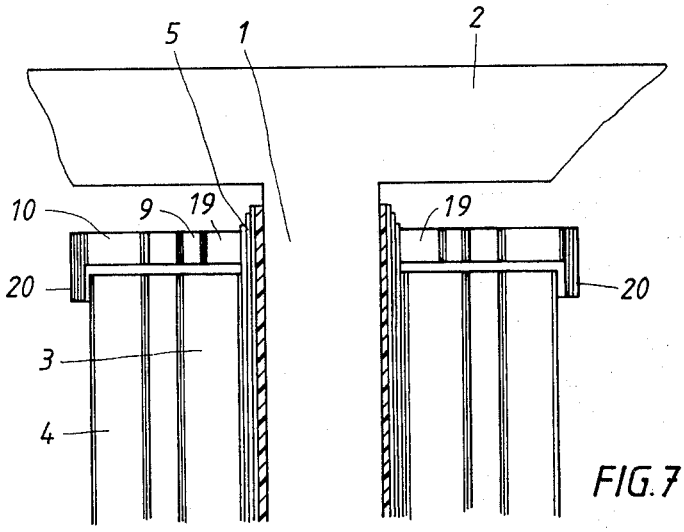
FIG. 7 shows the ends of windings on an enlarged scale.

FIG. 7 illustrates in more detail the embodiment of sloping shield 5 at one end of winding 3 as well as a modified embodiment of the previously described flux-controlling rings 9 and 10 outside the ends of the windings. According to FIGS. 1 to 5, the innermost ring 9 extends inwardly toward shield 5 such that only a narrow gap separates them. However, investigations performed show that if the inner diameter of innermost ring 9 is increased so that a relatively wide space 19 is formed between shield 5 and the ring, a considerable reduction of the radial flux component which endeavours to penetrate into the shield is achieved.

Figure 8:
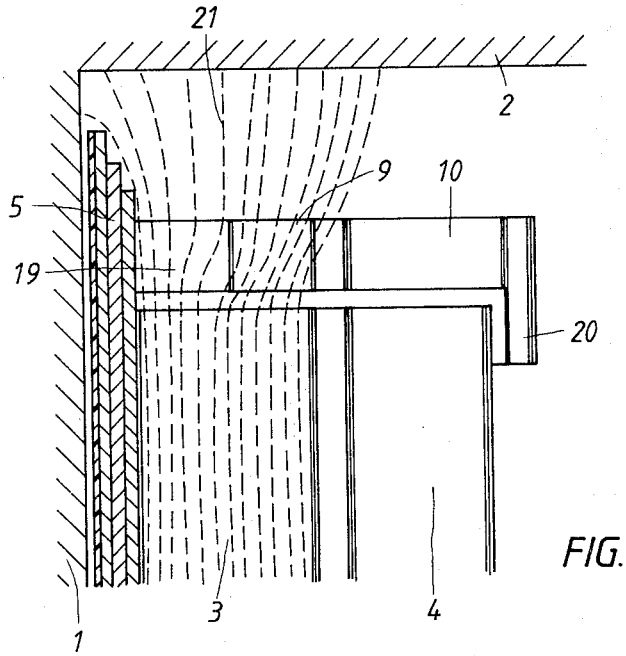
FIG. 8 shows the extension of the leakage flux at one end of the windings.

This reduction in the radial flux component is illustrated by FIG. 8 where the inner diameter of inner ring 9 has been increased so that annular gap 19 is formed between the inner ring and shield 5. The leakage flux passing through the inner winding 3 is shown by dashed lines 21. Gap 19, which has a low permeability in comparison with inner ring 9, causes a portion of the flux which flows from winding 3 into the gap to become deflected outwardly and enter into the inner ring. The deflection of a portion of the flux causes a reduction in the flux density in space 19 and thus also a reduction of the radial flux directed towards core leg 1. The combination of shield 5 directed towards yoke 2 and space 19 having low permeability between inner ring 9 and the shield therefore causes a deflection of the leakage flux from core leg 1 and thus a reduction of the additional losses in the inner end portions of inner winding 3. The sloping outer corner of shield 5 also contributes to a reduction of the additional losses. In addition, the previously shown embodiment of outer ring 10 provided with an axially directed projection 20 which surrounds the outer corner of outer winding 4 contributes advantageously to control of the leakage flux so that the additional losses at the outer corner of the outer winding are also reduced.

While the present invention has been described with reference to particular embodiments thereof, it will be understood that numerous modifications may be made by those skilled in the art without actually department from the spirit and scope of the invention as defined in the appended claims.

We claim:

1. A power transformer or reactor comprising a core containing magnetic material and having legs and yokes and comprising windings including a tape-formed conductor material arranged concentrically around a core leg, the innermost of the windings having a first portion located nearest the core leg which has an axial length greater than the length of all of the remaining portion of the winding located radially outside said first portion, said first portion forming a cylindrical shield for controlling the magnetic leakage flux appearing axially outside the ends of the winding.

2. A transformer according to claim 1 wherein said shield has an axial length which decreases stepwise with increasing radial extension of the winding.

3. A transformer according to claim 1 said shield has an axial length which continuously decreases with increasing radial extension of the winding.

4. A transformer according to claim 1 or 2 wherein at least the outermost of the windings arranged around a core leg has an axial length decreasing towards the radially outer surface of the winding.

5. A transformer according to claim 1 further including ring-formed flux-controlling bodies having high permeability located axially outside the ends of at least the outermost winding, the flux-controlling bodies located at the ends of the outermost winding having an outer radius which is greater than the outer radius of the winding, the portion of said bodies which lies radially outside the winding extending axially inwardly past the outer corner of the winding.

6. A transformer according to claim 1 or 5 further including ring-formed flux-controlling bodies having high permeability located axially outside the ends of at least the innermost winding and radially outside said shield at the inner edge of the innermost winding, the flux-controlling body located outside the ends of the innermost winding having an inner radius which is considerably greater than the outer radius of the shield so as to form an annular space between the innermost flux-controlling body and the shield where a considerably lower permeability prevails than in the flux-controlling body.

* * * * *